US007177574B2

(12) United States Patent
Tanaka

(10) Patent No.: US 7,177,574 B2
(45) Date of Patent: Feb. 13, 2007

(54) IMAGE FORMING APPARATUS AND DEVELOPING GAP ADJUSTING METHOD IN IMAGE FORMING APPARATUS

(75) Inventor: Yoshiaki Tanaka, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/997,908

(22) Filed: Nov. 29, 2004

(65) Prior Publication Data

US 2006/0115299 A1 Jun. 1, 2006

(51) Int. Cl.
*G03G 15/01* (2006.01)

(52) U.S. Cl. ..... 399/227; 399/119; 399/226; 399/223

(58) Field of Classification Search ..... 399/227, 399/226, 107, 119, 223, 225
See application file for complete search history.

(56) References Cited

U.S. PATENT DOCUMENTS 5,612,769 A * 3/1997 Sugihara et al. ..... 399/119
5,940,657 A * 8/1999 Yokomori et al. ..... 399/119

FOREIGN PATENT DOCUMENTS

JP 07199648 A * 8/1995
JP 2002-287489 A 10/2002

* cited by examiner

*Primary Examiner*—David M. Gray
*Assistant Examiner*—Ryan D. Walsh
(74) *Attorney, Agent, or Firm*—Foley & Lardner LLP

(57) ABSTRACT

In the image forming apparatus of the present invention, a developing roller is press fit into the rotor at the edge of the rotary holder of the revolver type color developing device that is positioned against the photosensitive drum and a developing gap between the photosensitive drum and the developing roller is finely adjusted in parallel to a line connecting the center of the photosensitive drum and the rotary holder by sliding the developing roller in the rotor by the adjuster. Irrespective of the adjustment of the developing gap, the developing position on the photosensitive drum is always kept at a constant position and a developing image of high level of quality is obtained.

20 Claims, 12 Drawing Sheets

IMAGE FORMING APPARATUS AND DEVELOPING GAP ADJUSTING METHOD IN IMAGE FORMING APPARATUS

BACKGROUND OF THE INVENTION

1. Field of the Invention

The present invention is concerned with such image forming apparatus as electro-photographic apparatus, printers, etc. and relates to an image forming apparatus to obtain color developing images using a revolver type color developing device.

2. Description of the Related Art

For a multi-color image forming apparatus having the plural number of developing units in order to obtain color images according to electro-photographing system of color copiers, color printers, etc., the downsizing is so far demanded. In response to this demand, a revolver type color developing device is developed in recent years. In this revolver type color developing device, 3 developing units to supply yellow (Y), magenta (M) and cyan (C) toners, respectively are installed in a single rotating holder and the rotary holder further equipped with a black (BK) toner additionally is rotated to arrange the developing units in specified colors sequentially at a position opposite to the photosensitive drum and develop a latent image on the photosensitive drum.

In this revolver type color developing device, in order to obtain a highly precise developing image, it is desired to control a developing gap between the developing units and a photoreceptor precisely. In the Japanese Patent Application Publication No. 2002-287489, an image forming apparatus is disclosed. In this image forming apparatus, a photosensitive drum and a revolver type color developing device are maintained at a specified distance and a developing gap is adjusted by adjusting the position of the developing rollers by a developing roller position adjusting holder that is capable of oscillating centering around the supporting point.

However, in this conventional image forming apparatus, the positions of the developing rollers are adjusted by the rotation and movement of the developing roller position adjusting holder. Therefore, whenever the developing roller position adjusting holder is adjusted, the position of the developing roller opposing to the photosensitive drum is shifted from the line connecting the centers of the revolver type color developing device and the photosensitive drum. That is, whenever the developing roller adjusting holder is adjusted, the developing position on the photosensitive drum is shifted the optimum development by the developing roller cannot be obtained and the highly precise development of images is impeded.

Therefore, for a revolver type color developing device to achieve the downsizing of an image forming apparatus, the development of an image forming apparatus capable of easily adjusting a gap between a photosensitive drum and developing rollers without changing the developing position on the photosensitive drum and obtaining highly precise and good reproducible developer images is desired.

SUMMARY OF THE INVENTION

It is an object of this invention to provide an image forming apparatus and a developing gap adjusting method thereof to obtain highly precise and reproducible high grade, highly precise and reproducible images by adjusting a gap between the developing rollers of a revolving type developing device and a photosensitive drum easily and precisely.

According to the embodiment of the present invention, there is provided an image forming apparatus comprising: an image carrier; a developing unit equipped with a developing roller to supply developer to the image carrier; a rotatable supporting member positioned for the image carrier to support the developing unit; a guide provided in a periphery of the supporting member and capable of sliding the developing roller at the position opposite to the image carrier in parallel with a line connecting the rotating center of the image carrier and the rotating center of the supporting member; and an adjusting member to move the developing roller in the guide, set the position of the developing roller in the guide and finely adjust a gap between the image carrier and the developing roller.

DETAILED DESCRIPTION OF THE INVENTION

The embodiment of this invention will be described below in detail referring to the attached drawings.

Figure 1:
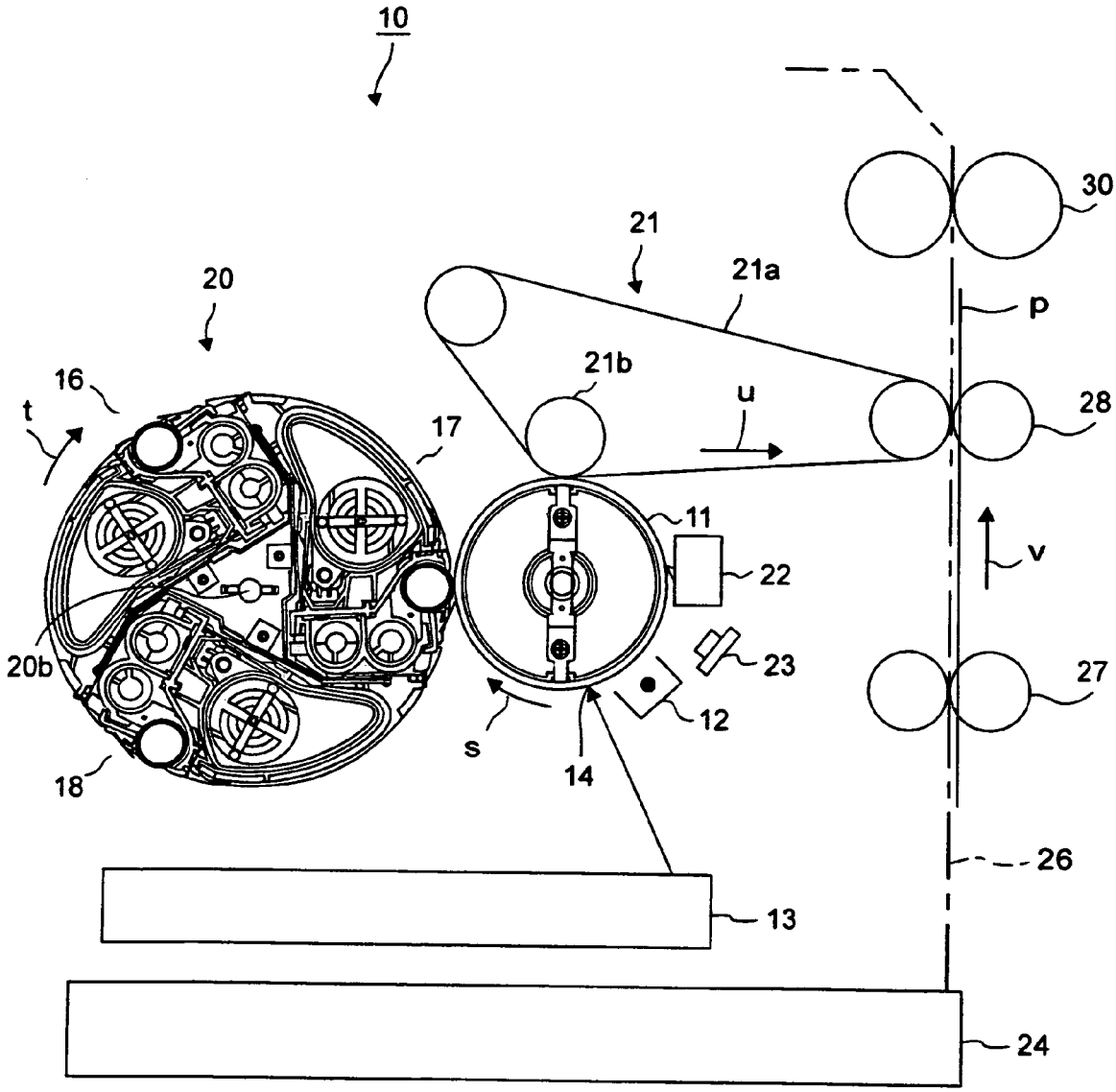
FIG. 1 is a schematic construction diagram showing the image forming unit in the embodiment of this invention.

FIG. 1 is a schematic construction diagram showing an image forming unit 10 of such an image forming apparatus as a color printer, etc. in the embodiment of this invention. Around photosensitive drum 11, which is an image carrier, of image forming unit 10, a main charger 12 to uniformly charge photosensitive drum 11 following its rotation in the arrow direction s and an irradiation position 14 of a laser beam 13*a* from a laser writing unit 13 for forming a latent image on charged photosensitive drum 11 are arranged. Further, around photosensitive drum 11, there are a revolver type color developing device 20 to support developing units 16, 17, 18 rotatably in the arrow direction t by the rotating holder 20*a* for developing a latent image on photosensitive drum 11 with yellow (Y), magenta (M) and cyan (C) developers, a middle transfer unit 21 having a middle transfer belt 21*a* that rotates in the arrow direction u and a primary transfer roller 21*b*, a cleaning unit 22 and a charge eliminating lamp 23.

Below image forming unit 10, a paper supply cassette 24 housing recording paper (not shown) is provided and along a conveying path 36 of recording paper taken out from the paper supply cassette 24, an aligning roller pair 27 to align the front edge of the recording paper to the front edge of a toner image transferred on middle transfer belt 21*a*, a secondary transferring rollers 28 to transfer the toner image on middle transfer belt 21*a* on a recording paper and a fixing roller pair 30 to fix the toner image on a recording paper are arranged. A laser writing unit 13 forms an electrostatic latent image on photosensitive drum 11 by irradiating the laser beam corresponding to a writing signal for every color according to an image information that is input from an external computer terminal, etc.

Figure 2:
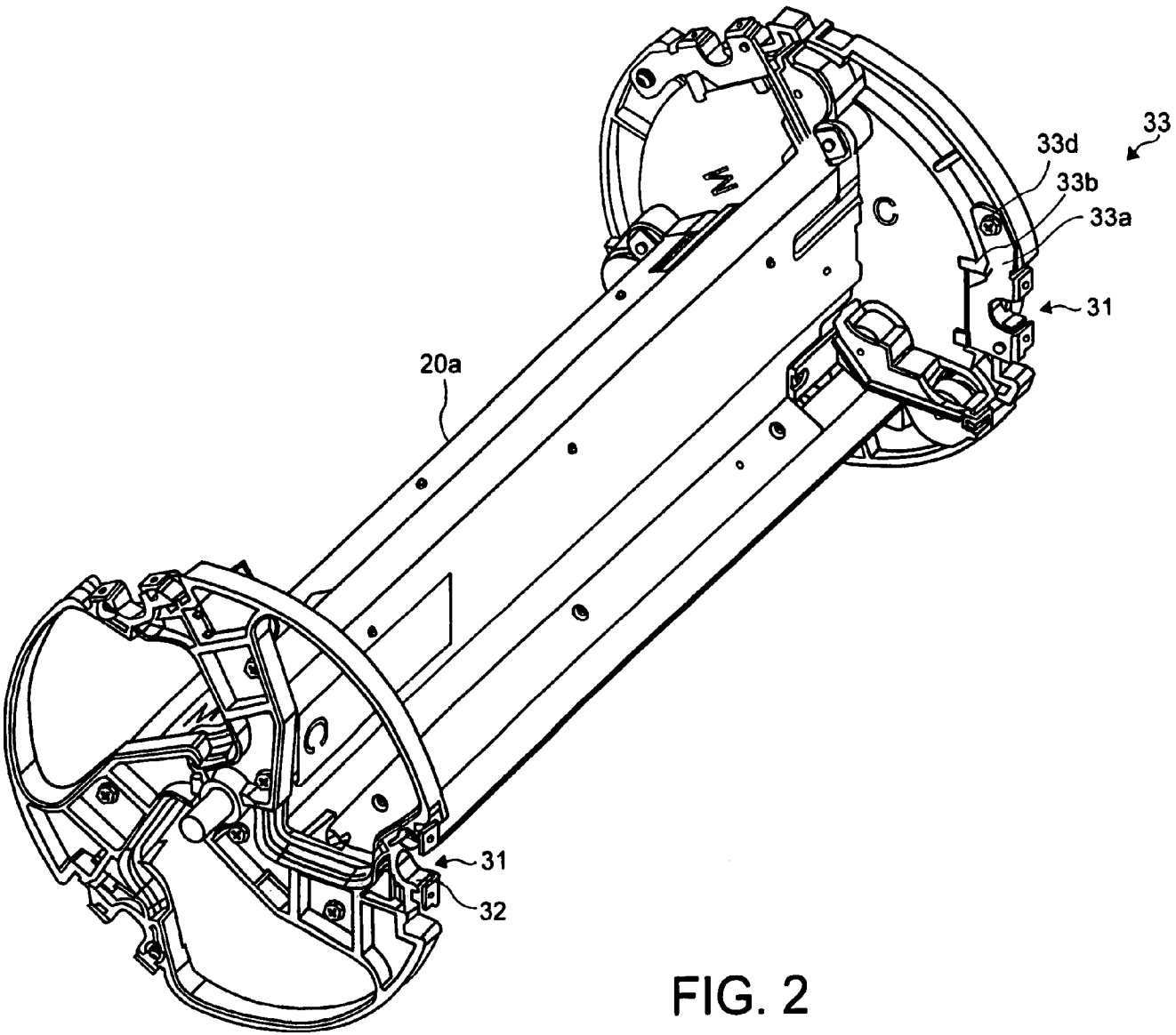
FIG. 2 is a perspective view showing the rotating holder in the embodiment of this invention.

Revolver type color developing device 20 supports developing units 16 to 18 by the revolving holder 20*a* so that they can be exchanged as shown in FIG. 2. Revolver type color developing device 20 rotates yellow (Y), magenta (M) and cyan (C) developing units 16 to 18 integrally by rotating the rotating holder 20*a* in the arrow direction t and arranges a desired developing unit 16 to 18 to a position opposing to photosensitive drum 11.

Figure 3:
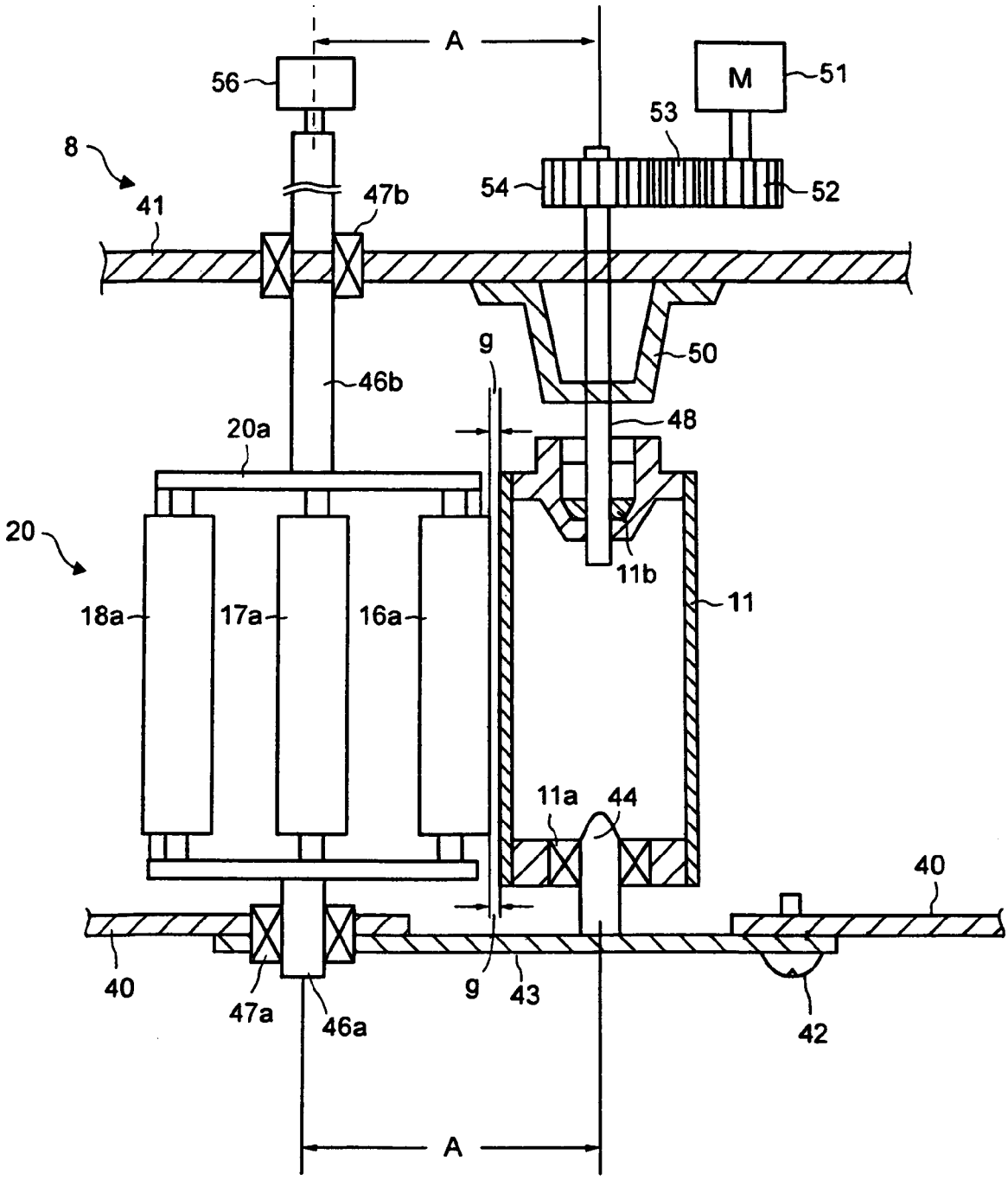
FIG. 3 is a schematic explanation diagram showing the construction to install the photosensitive drum and the revolver type color developing device of this invention.
Figure 4:
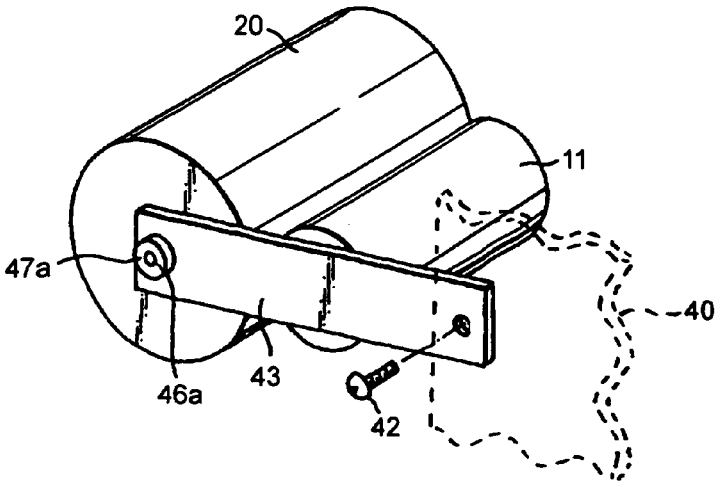
FIG. 4 is a perspective view showing a positioning plate to position the photosensitive drum against the revolving type developing device in the embodiment of this invention.

Photosensitive drum 11 and the revolver type color developing device 20 are installed between a front plate 40 and a rear plate 41 comprising the main unit 8 of the image forming apparatus as shown in FIG. 3 and FIG. 4. That is, the front side of photosensitive drum 11 is supported by a support pin 44 provided to a positioning plate 43 that is fixed to front plate 40 by a fixing screw 42. Positioning plate 43 positions revolver type color developing device 20 against photosensitive drum 11. Further, a front shaft 46*a* of rotating holder 20*a* of revolver type color developing device 20 is supported by the overlapped portion of positioning plate 43 and front plate 40 through a front bearing 47*a*.

On the other hand, the rear side of photosensitive drum 11 is connected to a drive shaft 48 that is held rotatably by rear plate 41. Drive shaft 48 that is driven by the rotation of a driving motor 51 through a driving gear 52, an idle gear 53 and a gear 54 is held rotatably to rear plate 41 through a drive shaft holder 50. Further, a rear shaft 46*b* of revolving holder 20*a* of revolver type color developing device is supported by rear plate 41 through rear bearing 47*b*. Revolving holder 20*a* is rotated by a stepping motor 56 that is connected to rear shaft 46*b*.

As a result, revolver type color developing device 20 is positioned without contacting photosensitive drum 11. At this time, a separating distance of the rotary shafts between revolver type color developing device 20 and photosensitive drum 11 becomes a dimension (A). This dimension (A) is set larger than a total size of the radius of revolver type color developing device 20 and the radius of photosensitive drum 11 by a specified amount. Accordingly, a developing gap (g) in a specified size is formed between developing rollers 16*a* to 18*a* supported by revolving holder 20*a* and photosensitive drum 11.

Figure 5:
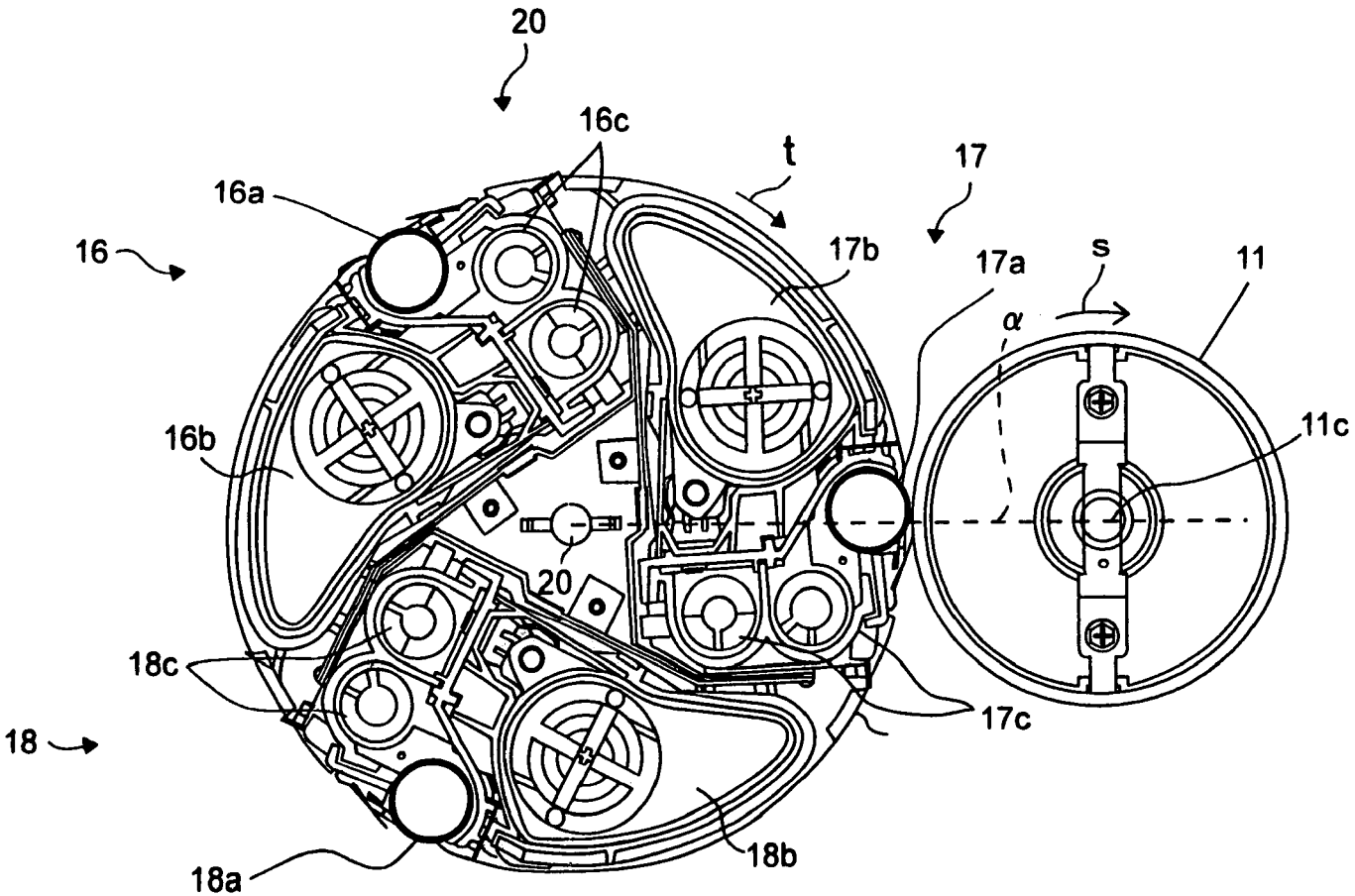
FIG. 5 is an explanatory drawing showing the developing unit supported to the revolving type developing device in the embodiment of this invention.
Figure 6:
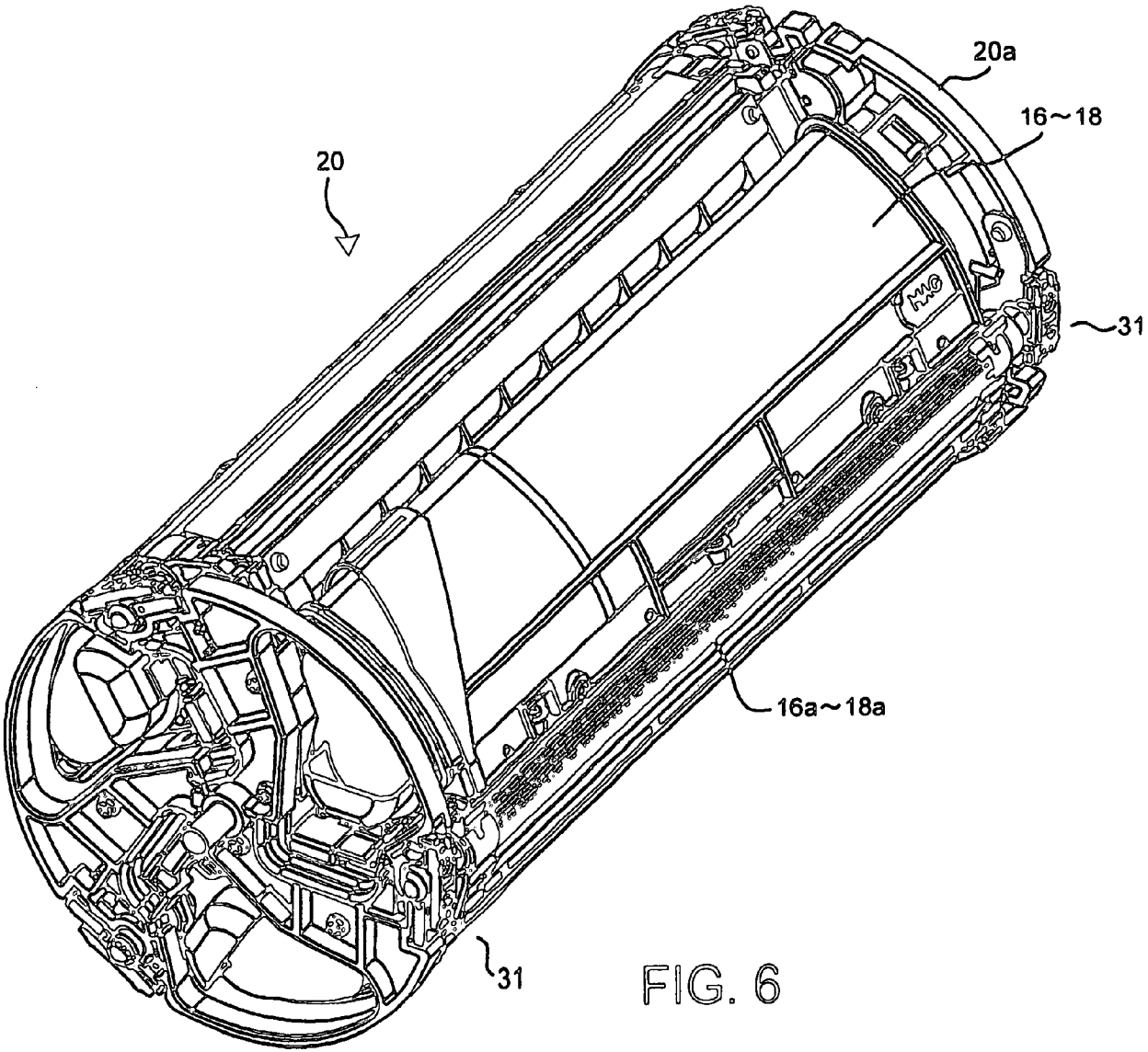
FIG. 6 is a perspective view showing the revolving type color developing device in the embodiment of this invention.

Next, revolver type color developing device 20 will be described in detail. Developing units 16 to 18 supported by revolving holder 20*a* have first to third developing rollers 16*a* to 18*a*, conveying augers 16*c* to 18*c* to supply yellow (Y), magenta (M) and cyan (C) toners in developer containers 16*b* to 18*b* to developing rollers 16*a* to 18*a*, respectively as shown in FIG. 5. Around revolving holder 20*a* of revolver type color developing device, there is provided a positioning unit 31 as shown in FIG. 2. The shafts at both ends of developing rollers 16*a* to 18*a* of first to third developing devices 16 to 18 are supported by positioning unit 31 through bearings as shown in FIG. 6.

Figure 7:
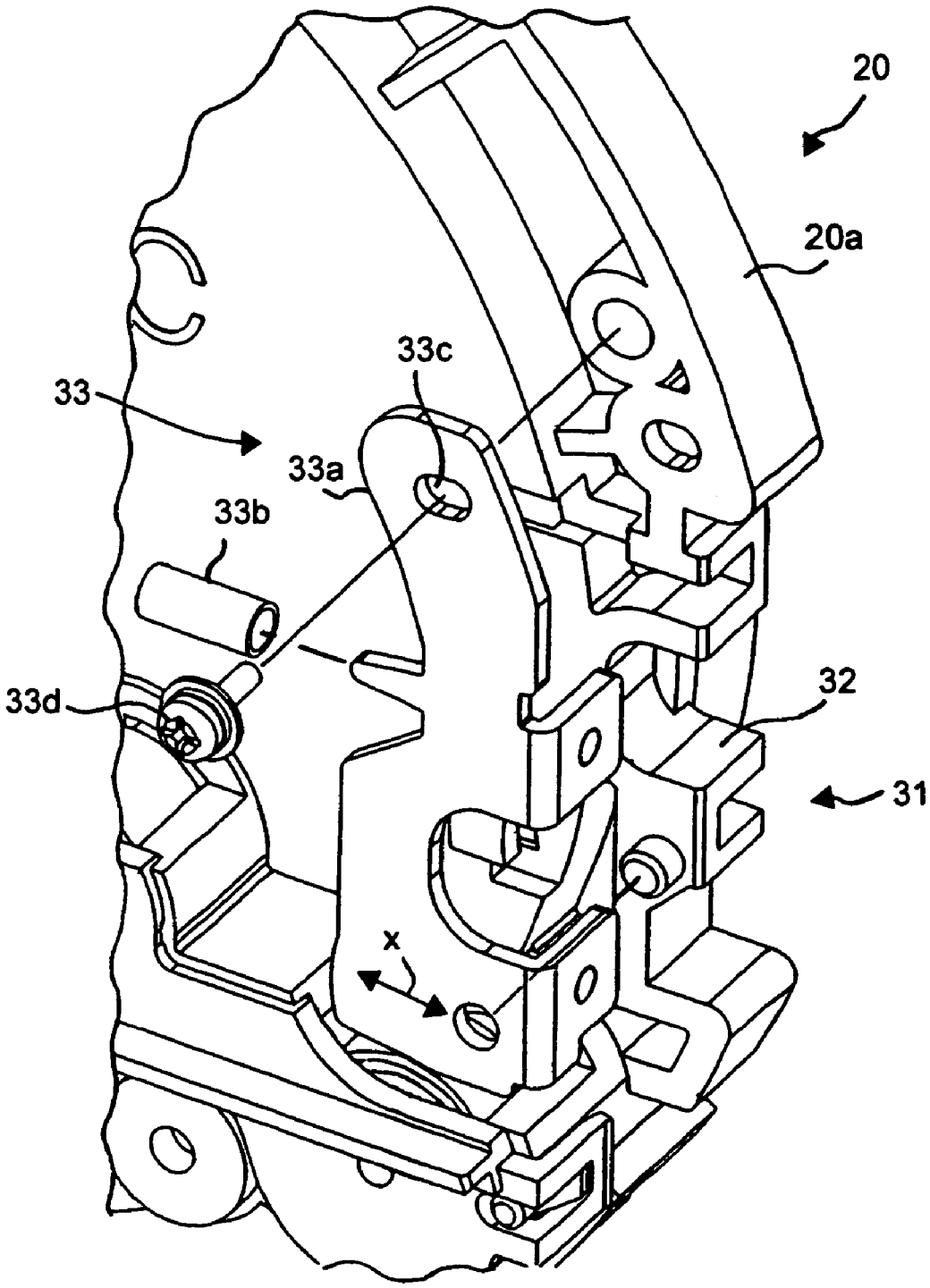
FIG. 7 is a perspective view showing the positioning member in the embodiment of this invention.
Figure 8:
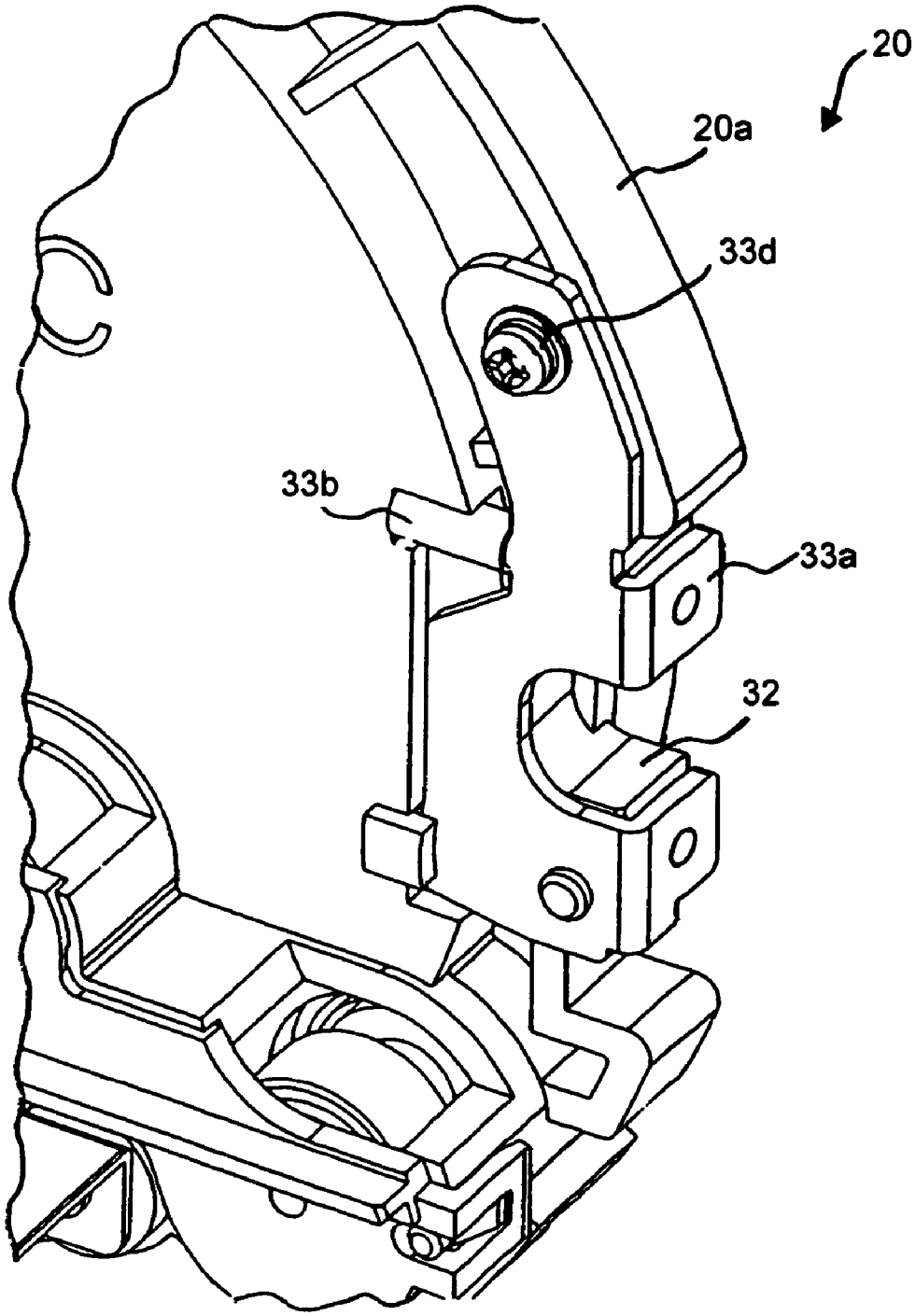
FIG. 8 is a perspective view showing the state of the adjuster of the positioning member fixed with a screw in the embodiment of this invention.
Figure 9:
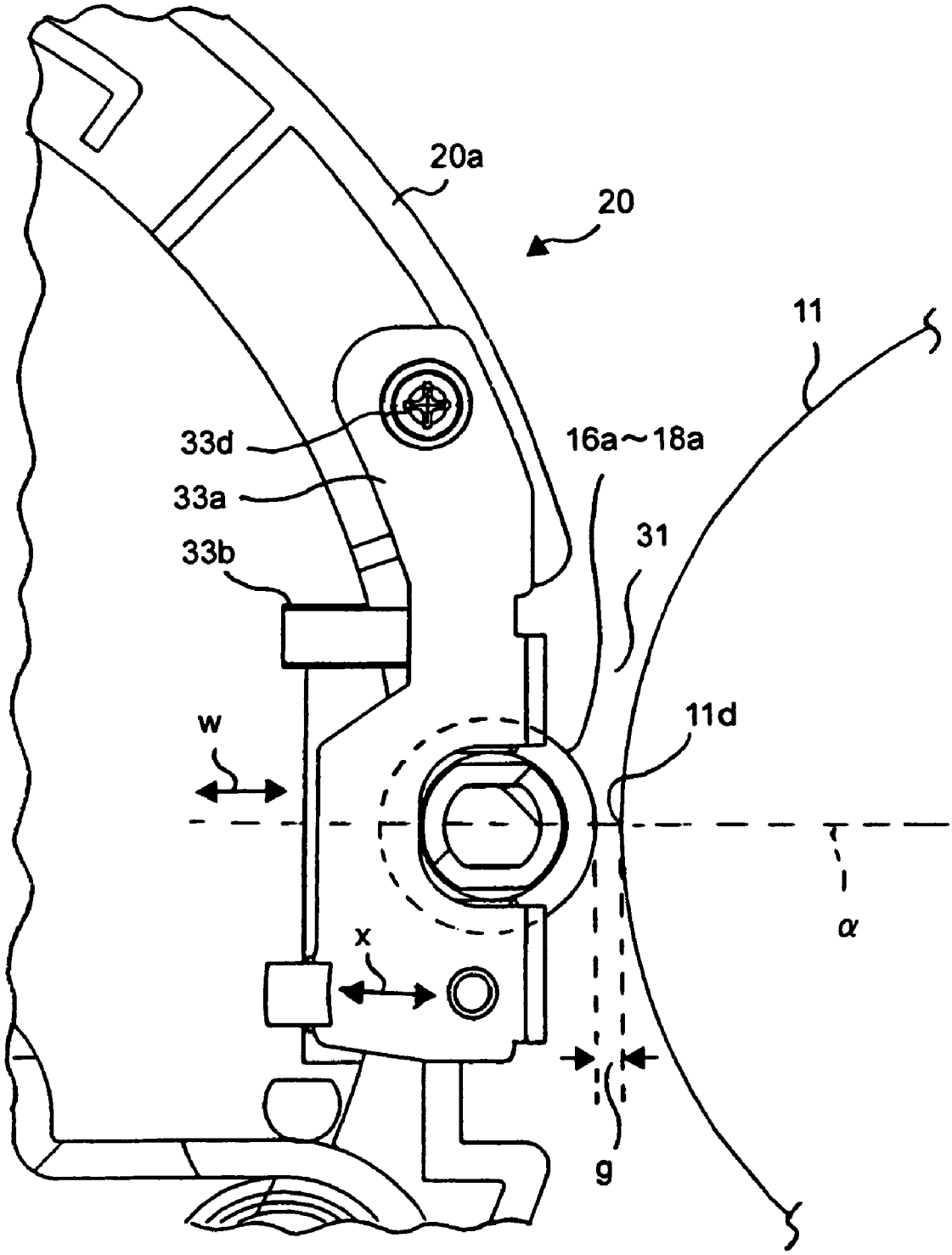
FIG. 9 is a side view showing the state to support the adjusting shaft by the positioning member in the embodiment of this invention.

Positioning unit 31 is a guide as shown in FIG. 7, FIG. 8 and FIG. 9, and is composed of a rotor 32 to which the shaft of both ends of developing rollers 16*a* to 18*a* are fit and an adjusting member 33. Rotor 32 is formed in parallel with a center line α connecting a center 20*b* of revolving holder 20*a* and a center 11*c* of photosensitive drum 11 when it is at the position opposite to photosensitive drum 11. Rotor 32 guides the shafts of both ends of developing rollers 16*a* to 18*a* so as to slide in the arrow direction w that is in parallel with the center line α.

Adjusting member 33 has an adjuster contacting the shafts at both ends of developing rollers 16*a* to 18*a* guided by rotor 32, a spring 33*b* that is an elastic member to press adjuster 33*a* toward photosensitive drum 11, and a screw 33*d* that is a fixing member to fix adjuster 33*a* to revolving holder 20*a* against the elastic force of spring 33*b* at an oscillating center 33*c* of adjuster 33*a* oscillating in the arrow direction x.

Figure 10:
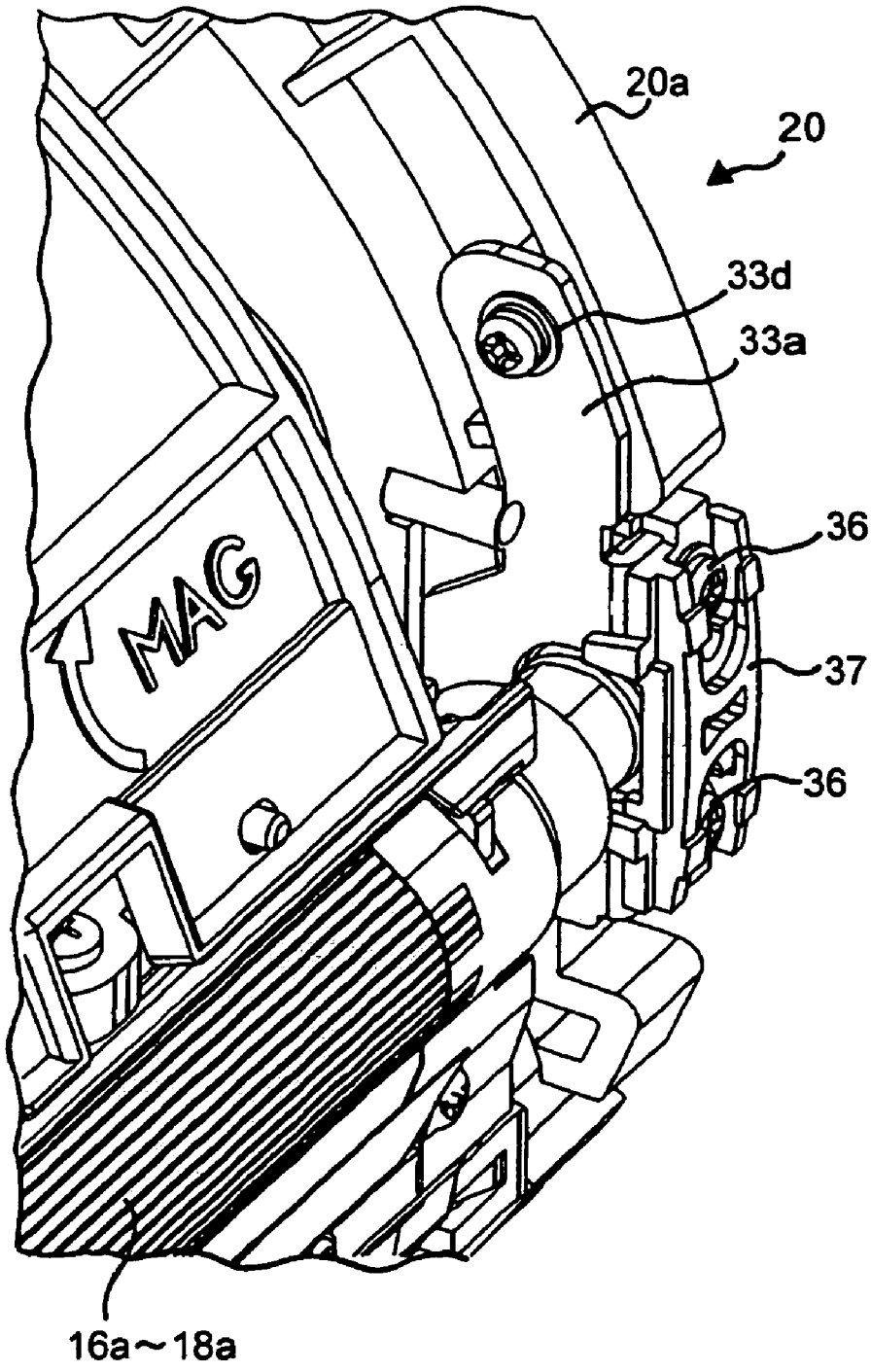
FIG. 10 is a perspective view showing the state of the developing roller by the holder in the embodiment of this invention.

The shafts at both ends of developing rollers 16*a* to 128*a* that fit to rotor 32 of positioning unit 31 move the set position in rotor 32 in the direction parallel to the center line α according to the fixed position of adjuster 33*a*. Thus, the developing gap between developing rollers 16*a* to 18*a* and photosensitive drum 11 is finely adjusted in parallel to the center line α. Further, positioning unit 31 has a holder 37 for fixing developing rollers 16*a* to 18*a* in rotor 32 as shown in FIG. 10. Holder 37 is attached to rotor 32 with a screw 36.

Next, the color image forming process by image forming unit 10 will be described. In this image forming unit 10, a color image is formed by superposing toner images in order of yellow (Y), magenta (M) and cyan (C). When starting the image forming, developing roller 16*a* of yellow (Y) developer 16 of revolver type color developing device 20 is arranged at a developing position opposite to photosensitive drum 11. At this time, the separating distance between the rotary shaft of developing roller 16*a* and photosensitive drum 11 is set at a dimension (A) by front plate 40 and rear plate 41, and a proper developing gap (g) is maintained.

When the image forming process starts, photosensitive drum 11 rotates in the arrow direction s and is uniformly charged by main charger 13 pursuant to the rotation and laser beam according to the yellow image signal is irradiated by laser writing unit 13. Thus, an electrostatic latent image of a yellow image is formed on photosensitive drum 11. Then when photosensitive drum 11 reaches revolver type color developing device 20, the yellow (Y) toner is electrostatically transferred and a yellow (Y) toner image is formed thereon.

Then, the toner image on photosensitive drum 11 reaches a position contracting middle transfer belt 21*a*, a transfer bias is applied from primary transfer roller 21 and the yellow toner image is electrostatically transferred primarily on middle transfer belt 21*a*. After the primary transfer, residual toner on photosensitive drum 11 is cleaned by belt cleaner 22 and the surface charge is eliminated by charge eliminating lamp 23.

Thereafter, likewise the yellow toner image forming process described above, the magent and cyan toner forming processes are repeated sequentially. Then, the yellow (Y), magenta (M) and cyan (C) toner images are transferred sequentially and a color toner image with 3 color toner images superposed is formed on middle transfer belt 21. While revolver type color developing device 20 is rotated sequentially in the arrow direction by stepping motor 56, developing rollers 16*a* to 18*a* corresponding to toner image colors that are formed on photosensitive drum 11 are positioned to oppose to photosensitive drum 11.

The yellow (Y), magenta (M) and cyan (C) color toner images superposed each other on middle transfer belt 21*a* are transferred collectively on a recording paper P taken out from paper supply cassette 24 in the arrow direction v and conveyed to the position of secondary transfer roller 28 in sync with a color toner image. Thus, a color image formation on a recording paper P is completed.

When developing units 16 to 18 or revolver type color developing device is deteriorated as the required number of image forming sheets is passed or a specified time elapsed while the image forming process is thus repeated, the exchange maintenance of these components is performed. However, after exchanging developing units 16 to 18 on revolving holder 20*a* or after revolver type color developing device 20 was removed and a new revolver type color developing device is installed, it is necessary to finely adjust the developing gap (g) between new developing rollers 16*a* to 18*a* and photosensitive drum 11 precisely.

Figure 11:
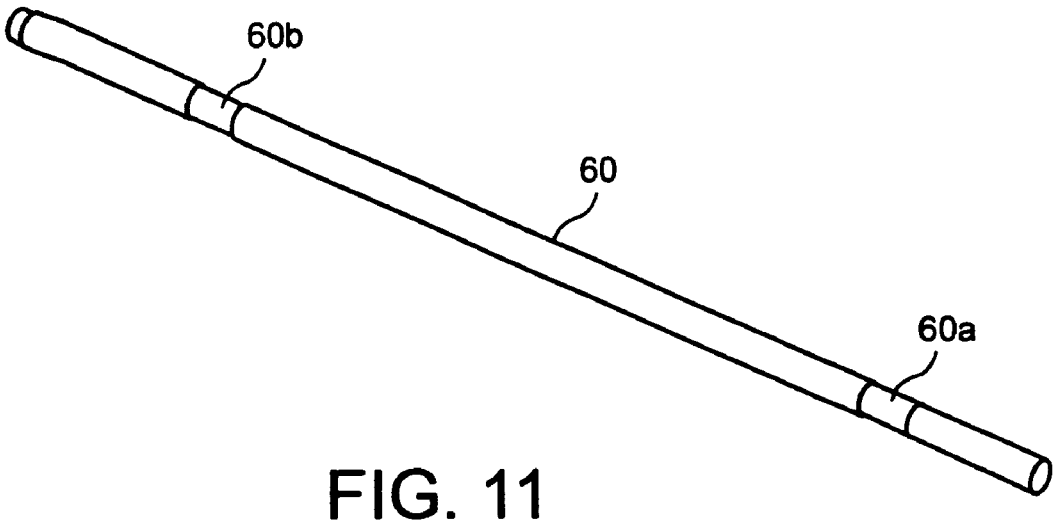
FIG. 11 is a perspective view showing the adjusting shaft in the embodiment of this invention.
Figure 12:
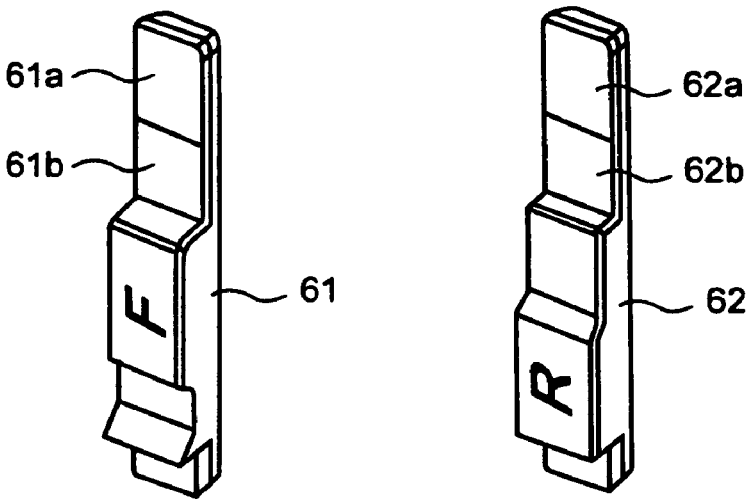
FIG. 12 is a perspective view showing the adjusting gauges in the embodiment of this invention.

Next, the fine adjustment of the positions of developing rollers 16*a* to 18*a* in positioning unit 31 for fine adjustment of developing gap (g) between developing rollers 16*a* to 18*a* and photosensitive drum 11 will be described. For the fine adjustment of positions of developing rollers 16*a* to 18*a*, an adjusting shaft 60 shown in FIG. 11 and a front gauge 61 and a rear gauge 62 that are adjusting gauges are used as adjusting tools. Adjusting shaft 60 is formed in a diameter slightly smaller than the diameter of developing rollers 16*a* to 18*a*, and measuring positions 60*a*, 60*b* to which front gauge 61 or rear gauge 62 is placed are more finely processed. Measuring positions 60*a* and 60*b* are set up to locate in the non-image forming area of photosensitive drum 11.

An adjusting gap (not shown) is formed between adjusting shaft 60 and photosensitive drum 11 when adjusting shaft 60 is installed in revolving holder 20*a* at the time when adjusting the gap. The adjusting gap is set wider than the adjusting gap (g) by an amount equivalent to the diameter of adjusting shaft 60 thinner than the diameter of developing rollers 16*a* to 18*a*.

Front gauge 61 and rear gauge 62 have (DO) positions 61*a*, 62*a* which are proper regions in thickness equivalent to a proper adjusting gap between adjusting shaft 60 and photosensitive drum 11 and (NO-GO) positions 61*b*, 62*b* which are thicker than GO positions 61*a*, 62*a*, respectively.

When developing rollers 16*a* to 18*a* are installed to positioning unit 31 for adjusting shaft 60 after finely adjusting the fixed position of adjuster 33*a* of positioning unit 31 using the above-mentioned adjusting tools, the fine adjustment of the developing (g) between developing rollers 16*a* to 18*a* is completed.

Next, the adjusting operation will be described in detail. When starting the fine adjusting process of the developing gap (g), first change the operation mode of the image forming apparatus to the developing gap adjusting mode. Then, by opening the side frame of the main body of the apparatus, rotate revolving holder 20*a* in the arrow direction t by stepping motor 56 so that positioning unit 31 of revolving holder 20*a* comes to the exchange work position at the side frame. When positioning unit 31 reaches the exchange work position at the side frame side and revolving holder 20 stops, install adjusting shaft 60 to positioning unit 31. After fitting adjusting shaft 60 in rotor 32, fix holder 37 with screw 36.

Figure 13:
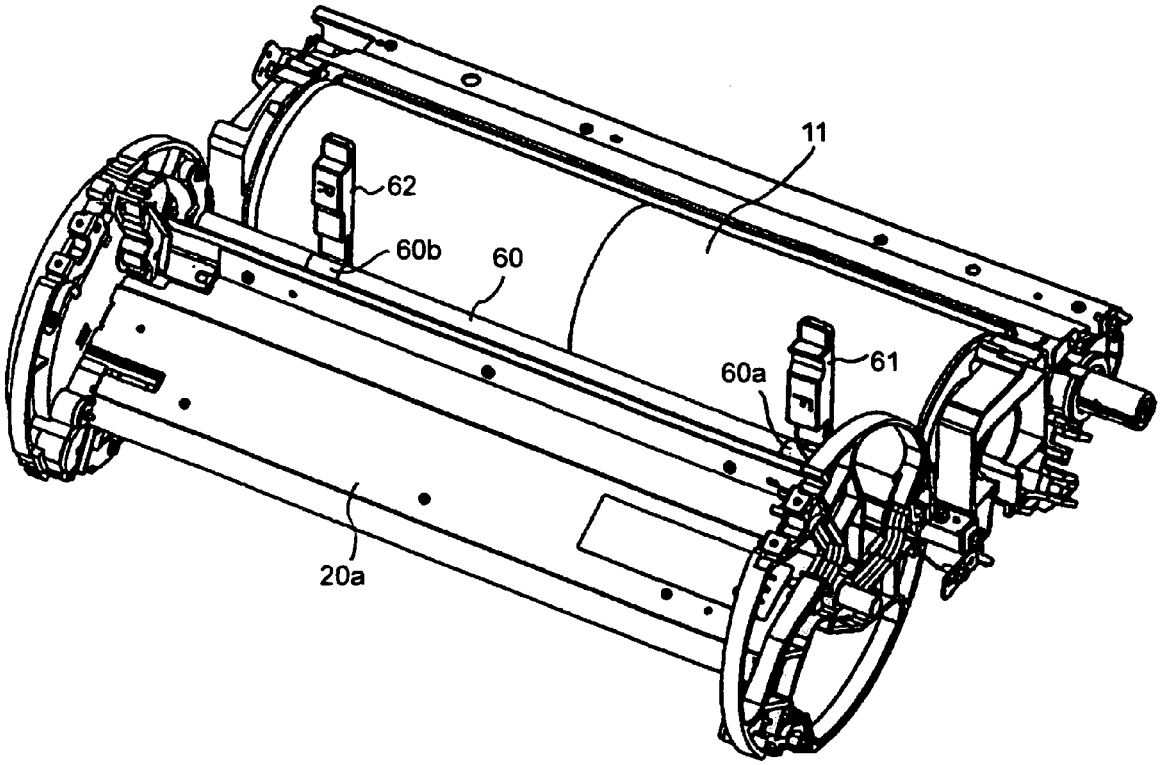
FIG. 13 is a schematic perspective view showing the state of a developing gap adjusted by the adjusting gauges in the embodiment of this invention.

Then, when revolving holder 20*a* is rotated in the arrow direction t by stepping motor 56, revolving holder 20*a* stops at a position where adjusting shaft 60 is opposed to photosensitive drum 11. In this state, insert front gauge 61 and rear gauge 62 between adjusting shaft 60 and photosensitive drum 11 as shown in FIG. 13 and adjust the fixed position of adjuster 33*a* of adjusting member 33.

Figure 14:
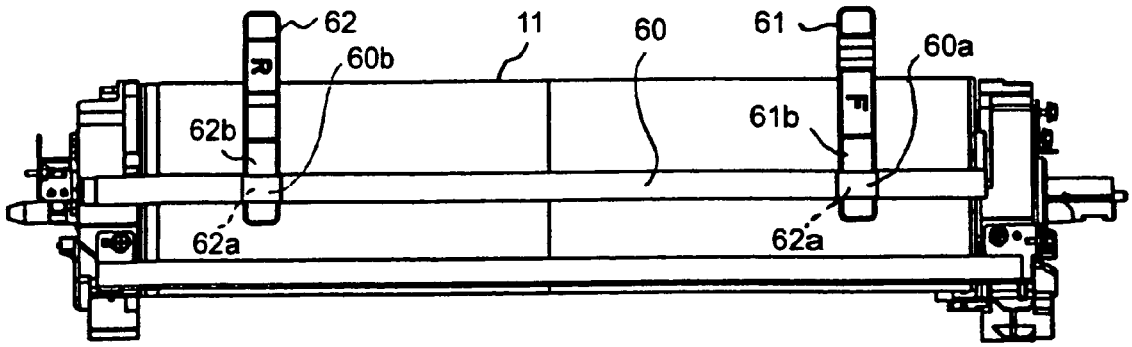
FIG. 14 is a schematic perspective view showing the state of the adjusting gauges when the developing gap is proper in the embodiment of this invention.

First, make screw 33*d* fixing adjuster 33*a* loose and bias adjuster 33*a* in the direction of photosensitive drum 11 by spring 33*b*. Then, by inserting (GO) positions 61*a* and 62*a* of front gauge 61 and rear gauge 62 at measuring positions 60*a* and 60*b* of adjusting shaft 60 between adjusting shaft 60 and photosensitive drum 11 by the biasing force of spring 33*b* as shown in FIG. 14, maintain the adjusting gap between adjusting shaft 60 and photosensitive drum 11 at a proper adjusting gap. In this state, fix adjuster 33*a* with screw 33*d* because adjuster 33*a* is adjusted to locate at a proper position.

Figure 15:
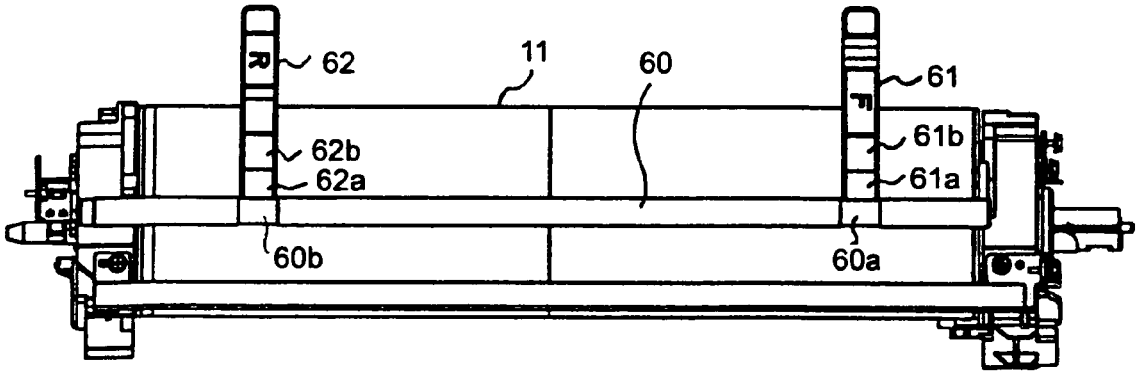
FIG. 15 is a schematic perspective view showing the state of the adjusting gauges when the developing gap is narrow in the embodiment of this invention.
Figure 16:
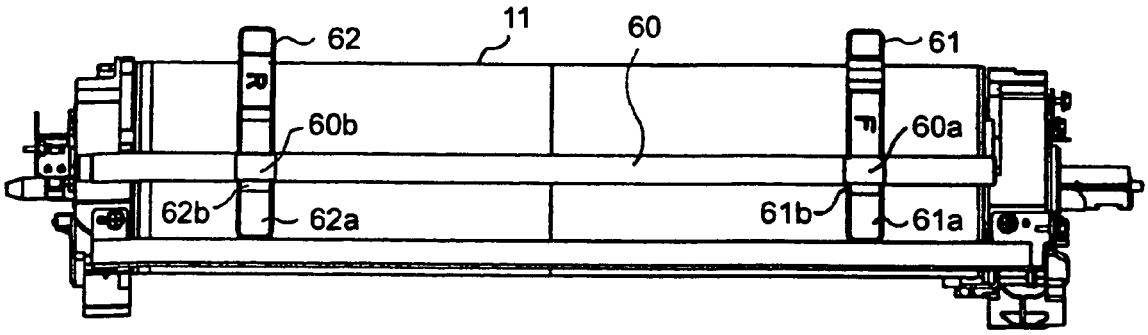
FIG. 16 is a schematic perspective view showing the adjusting gauges when the developing gap is wide in the embodiment of this invention.

In the state wherein (GO) positions 61*a* and 62*a* of front gauge 61 and rear gauge 62 are not inserted between adjusting shaft 60 and photosensitive drum 11 as shown in FIG. 15, it is confirmed that the adjusting gap is narrower than a proper range. Further, when (NO-GO) positions 61*b* and 62*b* of front gauge 61 and rear gauge 62 are also inserted between adjusting shaft 60 and photosensitive drum 11 as shown in FIG. 16, it is confirmed that the adjusting gap is too wider than the proper range.

When the gap is too narrow or too wider as described above, adjust the gap finely by oscillating (GO) positions 61*a* and 62*a* of front gauge 61 and rear gauge 62 between adjusting shaft 60 and photosensitive drum 11. Adjusting shaft 60 slides in the arrow direction w that is in parallel with the center line α in rotor 32 according to the oscillation of adjuster 33*b* and the gap with photosensitive drum 11 is finely adjusted. Accordingly, the opposing position of adjusting shaft 60 in the vicinity of photosensitive drum 11 is kept on the center line α irrespective of the gap adjustment.

When revolving holder 20*a* is rotated again in the arrow direction t by stepping motor 56 after fixing adjuster 33*a* at a proper position, revolving holder 20*a* stops again at a position where adjusting shaft 60 reaches the exchanging work position. Then, exchange adjusting shaft 60 attached to positioning unit 31 with developing rollers 16*a* to 18*a*. Fit developing rollers 16*a* to 18*a* into rotor 32, holder 37 is screwed, developing rollers 16*a* to 18*a* are installed in revolving holder 20*a*, and the adjustment of the developing gap is completed. Similarly, after adjusting developing gap of every colors, return the operation mode of the image forming apparatus is to the normal image forming mode and make it possible to execute the forming process.

Despite of the developing gap adjusted according to the oscillation of adjuster 33, developing rollers 16*a* to 18*a* installed to positioning unit 31 of revolving holder 20*a* are regulated by rotor 32 and the adjusting direction becomes parallel to the center line α. Accordingly, irrespective of the fine adjustment of the developing gap (g), it is possible to hold the developing position around photosensitive drum 11 at an intersecting point 11*d* with the center line α and highly accurate development is obtained without possibility for shifting of the developing position on photosensitive drum 11.

This developing gap fine adjustment using shaft 60, front gauge 61 and rear gauge 62 is also executed for the developing gap maintenance when the developing gap (g) between developing rollers 16*a* to 18*a* and photosensitive drum 11 comes out of the proper range while the image forming process is repeated. Further, it is possible to make the fine adjustment of the developing gap in the similar manner in the image forming apparatus manufacturing process.

According to this embodiment, only by rotating adjuster 33*a* and adjusting its position, it is possible to move the supporting position of developing rollers 16*a* to 18*a* in revolver type color developing device 20 in the direction parallel to the center line α connecting the center 20*b* of revolving holder 20*a* and the center 11*c* of photosensitive drum 11. That is, despite of adjustment of the development gap (g) between developing rollers 16*a* to 18*a* and photosensitive drum 11 by moving the supporting position of developing rollers 16*a* to 18*a* in revolver type color developing device 20, it is possible to maintain the developing position on photosensitive drum 11 by developing rollers 16*a* to 18*a* always at a fixed position that is an intersecting point with the center line α without changing the developing position on photosensitive drum 11. Accordingly, a highly precise, excellently reproducible and high grade developing image without uneven density by the developing rollers 16*a* to 18*a* is always obtained and the image quality can be promoted.

Further, it is possible to adjust the position of adjuster 33*a* easily and highly precisely only by positioning adjusting shaft 60 between adjusting shaft 60 and photosensitive drum 11 so as to clamp (GO) positions 61*a* and 62*a* of front gauge 61 and rear gauge 62 using adjusting shat 60, front gauge 61 and rear gauge 62 and thereafter, only by exchanging adjusting shaft 60 and developing rollers 16*a* to 18*a*, developing gap (g) can be adjusted high precisely and improve the operability in the developing gap adjusting.

Further, this invention is not restricted to the above-mentioned embodiment and can be modified variously within the scope thereof. For example, the construction of the image forming apparatus is not limited, the number of developing units supported by rotatable supporting members, colors of developers of respective developing units, etc. are optional. Further, a positioning means between the image carrier and the supporting member is not limited and a positioning flange may be provided at the edge of the image carrier and the supporting member, respectively and the positioning between the image carrier and the supporting member may be decided by bringing this flange to contact.

Further, a size of the developing gap between the image carrier and the supporting member is not limited and the size of the developing gap may be changed at the front side and the rear side of the image forming apparatus as necessary.

According to this invention as described above in detail, in the image forming apparatus with the supporting member positioned to support the developing units for the image carrier, when adjusting a developing gap between the image carrier and the developing rollers of the developing unit, it is possible to adjust the developing gap by moving the developing rollers in parallel with a line connecting the image carrier and the rotating center of the supporting member. Accordingly, regardless of the adjustment of the developing gap, the developing position on the image carrier can be maintained always at the constant position and a developing image of high grade is obtained by the developing rollers without causing the drop of developing accuracy. Further, when adjusting the developing gap, it is possible to make the fine adjustment of the developing gap easily and highly precious, and the operability when adjusting the developing gap.

What is claimed is:

1. An image forming apparatus comprising:

an image carrier;

a developing unit equipped with a developing roller to supply developer to the image carrier;

a rotatable supporting member positioned for the image carrier to support the developing unit;

a guide provided in a periphery of the supporting member and capable of sliding the developing roller at the position opposite to the image carrier in parallel with a line connecting the rotating center of the image carrier and the rotating center of the supporting member;

an adjusting member to move the developing roller in the guide, set the position of the developing roller in the guide and finely adjust a gap between the image carrier and the developing roller; and a holder to hold the shaft of the developing roller at the set position in the guide after setting the developing roller position in the guide.

2. The image forming apparatus as claimed in claim 1, wherein the guide is formed to fit to a shaft of the developing roller in the periphery of the supporting member.

3. The image forming apparatus as claimed in claim 1, wherein the adjusting member has an adjuster that contacts the shaft of the developing roller and presses the adjuster by an elastic member in the direction of the image carrier while fixes the adjuster to the supporting member against the elastic force by the fixing member and sets the position of the shaft of the developing roller in the guide.

4. The image forming apparatus as claimed in claim 1, wherein the supporting member supports a plural number of the developing units and by rotating them integrally and position a desired developing unit opposite to the image carrier.

5. An image forming apparatus comprising:

an image carrier;

a plural number of developing units having developing rollers to supply different color developers, respectively to the image carrier;

a revolver type color developing device that is positioned against the image carrier, supports the plural number of developing units and by integrally rotating them to position a desired developing unit opposite to the image carrier;

a rotor provided in the periphery of the revolver type color developing device and is able to slide the developing roller in parallel to a line connecting the center of rotation of the image carrier and the center of rotation of the revolver type color developing device at the position opposing to the image carrier;

an adjusting member to set the developing roller position in the rotor and finely adjust a gap between the image carrier and the developing rollers by sliding the developing roller in the rotor; and a holder to hold a shaft of the developing roller at the set position in the rotor after the developing roller position in the rotor is set by the adjusting member.

6. The image forming apparatus as claimed in claim 5, wherein the rotor is formed as to fit in a shaft of the developing roller in the periphery of the revolver type color developing device.

7. The image forming apparatus as claimed in claim 5, wherein the adjusting member has an adjuster that contacts a shaft of the developing roller and presses the adjuster in the direction of the image carrier by a spring, while the adjuster is fixed to the revolver type color developing device against an elastic force of an elastic member and the position of the shaft of the developing roller in the rotor is set.

8. An image forming apparatus comprising:

image carrying means for carrying an image;

developing means having developer supplying means for supplying developers to the image carrying means;

rotatable supporting means that is positioned against the image carrying means for supporting the developing means;

guide means that is provided in the periphery of the supporting means for sliding the developer supplying means in parallel with a line connecting the center of rotation of the image carrying means and the center of rotation of the supporting means;

adjusting means for setting the position of the developer supplying means in the guide means by sliding the developer supplying means in the guide means and finely adjusting a gap between the image carrying means and the developer supplying means, wherein the adjusting means sets the position of the developer supplying means in the guide means; and holding means for holding a shaft of the developer supplying means at the set position in the guide means.

9. The image forming apparatus as claimed in claim 8, wherein the guide means is formed to fit with a shaft of the developer supplying means in the periphery of the supporting means.

10. The image forming apparatus as claimed in claim 8, wherein the adjusting means has contacting means for contacting a shaft of the developer supplying means and biasing the contacting means in the direction of the image carrying means by elastic means, and on the other hand, the contacting means is fixed to the supporting means against the elastic force of the elastic means by fixing means and the position of a shaft of the developer supplying means is set in the guide means.

11. The image forming apparatus as claimed in claim 8, wherein the supporting means supports the plural number of developing means and by integrally rotating the plural developing means, positions a desired developing means opposite to the image carrying means.

12. A developing gap adjusting method of an image forming apparatus to adjust a gap between an image carrier and a developing roller, which is supported by a rotatable supporting member and positioned opposite to the image carrier, to supply developer to the image carrier, the method comprising:

installing an adjusting shaft in a guide, which is provided in a periphery of the supporting member and capable of sliding the developing roller at the position opposite to the image carrier in parallel with a line connecting the rotating center of the image carrier and the rotating center of the supporting member;

positioning the adjusting shaft opposite to the image carrier by rotating the support member;

adjusting a gap between the image carrier and the adjusting shaft to a specified value by sliding the adjusting shaft in the guide to contact the movable adjusting member;

setting up the position of the adjusting shaft in the guide by fixing the adjusting member in the state where the gap between the image carrier and the adjusting shaft is at a specified value; and installing the developing roller in the guide by exchanging with the adjusting shafts, wherein the adjusting step adjusts so that a proper region in a same thickness as the specified value of an adjusting gauge is put in the gap between the image carrier and the adjusting shaft.

13. The method as claimed in claim 12, wherein the adjusting gauge is integrally composed of a proper region and an improper region that is thicker than the proper region and the adjusting step adjust so that the proper region only of the adjusting gauge is put in the gap between the image carrier and the adjusting shaft.

14. The method as claimed in claim 12, wherein the adjusting shaft is smaller in diameter than the developing roller.

15. The method as claimed in claim 12, wherein the adjusting shaft has a gap measuring position in the non image forming area of the image carrier.

16. The method as claimed in claim 12, wherein the guide is formed so as to fit in the adjusting shaft or the developing roller shaft in the periphery of the supporting member.

17. The method as claimed in claim 16, wherein the adjusting shaft or the developing roller is fit in the guide by moving in a normal direction of the rotation of the support member.

18. The method as claimed in claim 12, wherein the adjusting member has an adjuster to contact the developing roller shaft, an elastic member to bias the adjuster in the direction of the image carrier, and a fixing member to fix the adjuster to the supporting member against the elastic force of the elastic member and the adjusting step executes in the state where the fixing of the adjuster by the fixing member is released and the elastic force of the elastic member is acting.

19. The method as claimed in claim 18, wherein the setting up step fixes the adjuster to the supporting member by the fixing member.

20. The method as claimed in claim 12, wherein the supporting member supports a plural number of developing rollers and positions a desired developing roller opposite to the image carrier by rotating the plural number of developing rollers integrally.

* * * * *